US011454161B2

(12) United States Patent
Zeng et al.

(10) Patent No.: US 11,454,161 B2
(45) Date of Patent: Sep. 27, 2022

(54) THERMOSTAT FAULT DIAGNOSIS METHOD AND DEVICE, COMPUTER DEVICE AND STORAGE MEDIUM

(71) Applicant: Guangzhou Automobile Group Co., Ltd., Guangdong (CN)

(72) Inventors: Jiao Zeng, Guangdong (CN); Yanju Qiao, Guangdong (CN); Zhenxiao Bai, Guangdong (CN); Xuetong Lian, Guangdong (CN); Qingpeng Su, Guangdong (CN); Jujiang Liu, Guangdong (CN)

(73) Assignee: GUANGZHOU AUTOMOBILE GROUP CO., LTD., Guangzhou (CN)

( * ) Notice: Subject to any disclaimer, the term of this patent is extended or adjusted under 35 U.S.C. 154(b) by 86 days.

(21) Appl. No.: 16/340,148

(22) PCT Filed: Oct. 23, 2018

(86) PCT No.: PCT/CN2018/111499
§ 371 (c)(1),
(2) Date: Apr. 8, 2019

(87) PCT Pub. No.: WO2019/100887
PCT Pub. Date: May 31, 2019

(65) Prior Publication Data

US 2021/0355857 A1 Nov. 18, 2021

(30) Foreign Application Priority Data

Nov. 24, 2017 (CN) ..... 201711194705.1

(51) Int. Cl.
*F01P 11/16* (2006.01)
*F01P 11/14* (2006.01)
*F01P 7/16* (2006.01)

(52) U.S. Cl.
CPC ..... *F01P 11/14* (2013.01); *F01P 7/16* (2013.01); *F01P 2025/13* (2013.01)

(58) Field of Classification Search
CPC ..... F01P 11/16; F01P 11/14; F01P 2031/00; F01P 2023/00; F01P 2031/20;
(Continued)

(56) References Cited

U.S. PATENT DOCUMENTS 6,279,390 B1 * 8/2001 Oka ..... F01P 11/16 73/114.68
6,321,695 B1 * 11/2001 Yoo ..... F01P 11/16 123/41.15

(Continued)

FOREIGN PATENT DOCUMENTS

CN 1680797 A 10/2005
CN 104110298 A 10/2014

(Continued)

*Primary Examiner* — Long T Tran
(74) *Attorney, Agent, or Firm* — ScienBiziP, P.C.

(57) ABSTRACT

The present disclosure relates to a thermostat fault diagnosis method. The method includes: a current environment temperature and a boundary temperature and initial opening temperature corresponding to the current environment temperature are acquired; engine thermal equilibrium state data determined based on coolant temperature change data in an engine are acquired; a current coolant temperature is acquired; and according to the engine thermal equilibrium state data and a relationship between the current coolant temperature and the boundary temperature and initial opening temperature, it is judged whether a thermostat is faulty.

7 Claims, 5 Drawing Sheets

(58) Field of Classification Search
CPC ..... F01P 2031/32; F01P 2025/30; F01P 5/14; F02D 41/22
See application file for complete search history.

(56) References Cited

U.S. PATENT DOCUMENTS

| | | | | |
|---|---|---|---|---|
| 6,532,807 | B1 | 3/2003 | Krauss | |
| 6,532,808 | B1 * | 3/2003 | Matsumoto | F01P 11/16 73/114.68 |
| 2001/0005807 | A1 * | 6/2001 | Kitajima | F02N 11/0803 701/112 |
| 2002/0156569 | A1 * | 10/2002 | Masuda | F01P 11/14 123/41.1 |
| 2003/0074117 | A1 * | 4/2003 | Oki | F01P 11/14 701/33.9 |
| 2005/0224019 | A1 * | 10/2005 | Kim | F02D 41/22 123/41.1 |
| 2007/0175414 | A1 | 8/2007 | Miyahara et al. | |
| 2015/0088364 | A1 * | 3/2015 | Sakayori | F01P 11/16 701/29.7 |

FOREIGN PATENT DOCUMENTS

| | | | |
|---|---|---|---|
| CN | 104727921 | A | 6/2015 |
| CN | 105240125 | A | 1/2016 |
| CN | 205977391 | U | 2/2017 |
| CN | 107956573 | A | 4/2018 |
| JP | 2000320389 | A | 11/2000 |
| JP | 2001329840 | A | 11/2001 |

* cited by examiner

THERMOSTAT FAULT DIAGNOSIS METHOD AND DEVICE, COMPUTER DEVICE AND STORAGE MEDIUM

TECHNICAL FIELD

The present disclosure relates to an automobile equipment fault diagnosis method, and more particularly to an engine thermostat fault diagnosis method and device, a computer device and a storage medium.

BACKGROUND

In automobile equipment, the thermostat is used to automatically adjust the amount of water entering a radiator according to the level of a coolant temperature, and change the circulation range of a coolant to adjust the heat dissipation capacity of a cooling system, thereby ensuring that an engine operates in a suitable temperature range. The thermostat should be maintained in a good technical state, otherwise the engine would not work properly. If the main valve of the thermostat opens too late, it will cause the engine to overheat; if the main valve opens too early, the warm-up time will be prolonged and the engine temperature will be too low.

At present, the thermostat diagnosis technology is mainly a water temperature model diagnosis method, that is, a model water temperature is calculated by using various operating parameters of the engine. When the model water temperature reaches a warm-up temperature, if the engine water temperature is lower than the warm-up temperature by a certain threshold, it is determined that the thermostat is faulty.

The water temperature model diagnosis method requires a large amount of calibration work to ensure the accuracy of water temperature model calculation, and the labor and resource costs are very high.

SUMMARY

In view of this, it is necessary to provide a method and device capable of diagnosing whether a thermostat is faulty without establishing a water temperature model for the problem that a thermostat diagnosis method is costly, a computer device, and a storage medium.

According to an embodiment of the present disclosure, an engine thermostat fault diagnosis method is provided, and the method includes: a current environment temperature and a boundary temperature and initial opening temperature corresponding to the current environment temperature, are acquired; engine thermal equilibrium state data determined based on coolant temperature change data in an engine is acquired; a current coolant temperature is acquired; and according to the engine thermal equilibrium state data and a relationship between the current coolant temperature and the boundary temperature and initial opening temperature, it is judged whether a thermostat is faulty.

By means of the above thermostat fault diagnosis method, it can be judged whether a thermostat is faulty according to a relationship between a current coolant temperature and a boundary temperature and initial opening temperature at a current environment temperature and engine thermal equilibrium state data without building a water temperature model, so that a determination result is more accurate, a large amount of standardization work is not needed, and the manpower and resource costs are reduced.

In an embodiment, the manner of judging whether a thermostat is faulty according to the engine thermal equilibrium state data and a relationship between the current coolant temperature and the boundary temperature and initial opening temperature includes the following steps: it is judged, when the current coolant temperature is less than the boundary temperature, whether the thermostat is faulty by a boundary temperature method according to the engine thermal equilibrium state data; it is judged, when the current coolant temperature is greater than or equal to the boundary temperature and is less than the initial opening temperature, whether the thermostat is faulty by a temperature drop learning method or an active control method according to the engine thermal equilibrium state data; and it is judged, when the current coolant temperature is greater than or equal to the initial opening temperature, whether the thermostat is faulty by a thermal equilibrium determination method or an inheritance determination method according to the engine thermal equilibrium state data.

In an embodiment, the manner of judging, when the current coolant temperature is less than the boundary temperature, whether the thermostat is faulty by a boundary temperature method according to the engine thermal equilibrium state data includes that: engine running time after starting and standard engine minimum warm-up time at the current environment temperature is acquired; and it is determined, when the engine running, time is greater than the standard engine minimum warm-up time and when the engine enters a thermal equilibrium state and the temperature is still less than the boundary temperature, that the thermostat is faulty.

In an embodiment, the manner of judging, when the current coolant temperature is greater than or equal to the boundary temperature and is less than the initial opening temperature, whether the thermostat is faulty by a temperature drop learning method or an active control method according to the engine thermal equilibrium state data includes that: an engine thermal equilibrium duration is acquired according to the engine thermal equilibrium state data; when the engine thermal equilibrium duration is greater than or equal to a standard thermal equilibrium time parameter, an engine heat dissipation system component is driven to work, a coolant temperature drop of the engine during each start of the engine heat dissipation system component is respectively acquired, when the number of times of the coolant temperature drop amplitude exceeding a first threshold is greater than or equal to a first preset number of times, it is determined that the thermostat is faulty, and when the number of times of the coolant temperature drop amplitude is lower than a second threshold is greater than or equal to a second preset number of times, it is determined that the thermostat is normal; and when the engine thermal equilibrium duration is less than the standard thermal equilibrium time parameter or fault determination cannot be performed by using a fan controller, if the number of times of the coolant temperature drop exceeding a third threshold is greater than a third preset number of times, it is determined that the thermostat is faulty.

In an embodiment, the manner of judging, when the current coolant temperature is greater than or equal to the initial opening temperature, whether the thermostat is faulty by a thermal equilibrium determination method or an inheritance determination method according to the engine thermal equilibrium state data includes that: a standard thermal equilibrium time parameter is acquired; a starting mode of the engine is determined based on a starting temperature; and if the starting mode is cold start, the engine thermal equilibrium duration is obtained according to an engine coolant temperature curve, and when the engine thermal equilibrium duration exceeds the standard thermal, equilibrium time parameter, it is determined that the thermostat is normal.

In an embodiment, the manner of judging, when the current coolant temperature is greater than or equal to the initial opening temperature, whether the thermostat is faulty by a thermal equilibrium determination method or an inheritance determination method according to the engine thermal equilibrium state data further includes that: if the starting mode is hot engine start, thermostat previous driving cycle fault state information is acquired, and it is judged whether the thermostat in a previous driving cycle is faulty according to the thermostat previous driving cycle fault state information.

In an embodiment, after it is determined that the thermostat is faulty, the method further includes the steps: fault state information is generated according to a fault determination result, and the fault state information is written into a history record fault storage space.

According to an embodiment of the present disclosure, a thermostat fault diagnosis device is provided, and the device includes: an environment temperature module, configured to acquire a current environment temperature and a boundary temperature and initial opening temperature corresponding to the current environment temperature; a thermal equilibrium data acquiring module, configured to acquire engine thermal equilibrium state data determined based on coolant temperature change data in an engine; a coolant temperature module, configured to acquire a current coolant temperature; and a fault determination module, configured to judge, according to the engine thermal equilibrium state data and a relationship between the current coolant temperature and the boundary temperature and initial opening temperature, whether a thermostat is faulty.

By means of the above thermostat fault diagnosis device, it can be judged whether a thermostat is faulty according to a relationship between a current coolant temperature and a boundary temperature and initial opening temperature at a current environment temperature and engine thermal equilibrium state data without building a water temperature model, so that a determination result is more accurate, a large amount of standardization work is not needed, and the manpower and resource costs are reduced.

According to an embodiment of the present disclosure, a computer device is provided. The computer device includes a memory, a processor and a computer program that is stored on the memory and runnable on the processor. The program is executed by the processor to implement the steps of the method according to any of the above.

According to an embodiment of the present disclosure, a computer-readable storage medium is provided. The computer-readable storage medium has a computer program stored thereon. The program is executed by a processor to implement the steps of the method according to any of the above.

By means of the above thermostat fault diagnosis method and device, the computer device and the computer-readable storage medium, it can be judged whether a thermostat is faulty according to a relationship between a current coolant temperature and a boundary temperature and initial opening temperature at a current environment temperature and engine thermal equilibrium state data without building a water temperature model, so that a determination result is more accurate, a large amount of standardization work is not needed, and the manpower and resource costs are reduced.

DETAILED DESCRIPTION OF THE EMBODIMENTS

In order to make the purposes, technical solutions and advantages of the present disclosure clearer, the present disclosure will be further described in detail below with reference to the accompanying drawings and embodiments. It is to be understood that the specific embodiments described herein are merely illustrative of the present disclosure and are not intended to limit the present disclosure.

Compared with Emission Standard CN5 On-Board Diagnostic (OBD) regulations, the CN6 OBD regulations, which began to be tested in 2018, have stricter diagnosis of a cooling system, thus increasing the requirements for thermostat diagnosis. That is, during a period of time after an engine is started or an equivalent calculation time, a coolant temperature cannot reach the other required maximum temperature of the OBD system or does not reach a warm-up temperature (the warm-up temperature is defined within an 11-degree deviation range of a thermostat adjustment temperature determined by a manufacturer), and in this case, the OBD system should detect a thermostat fault.

Figure 1:
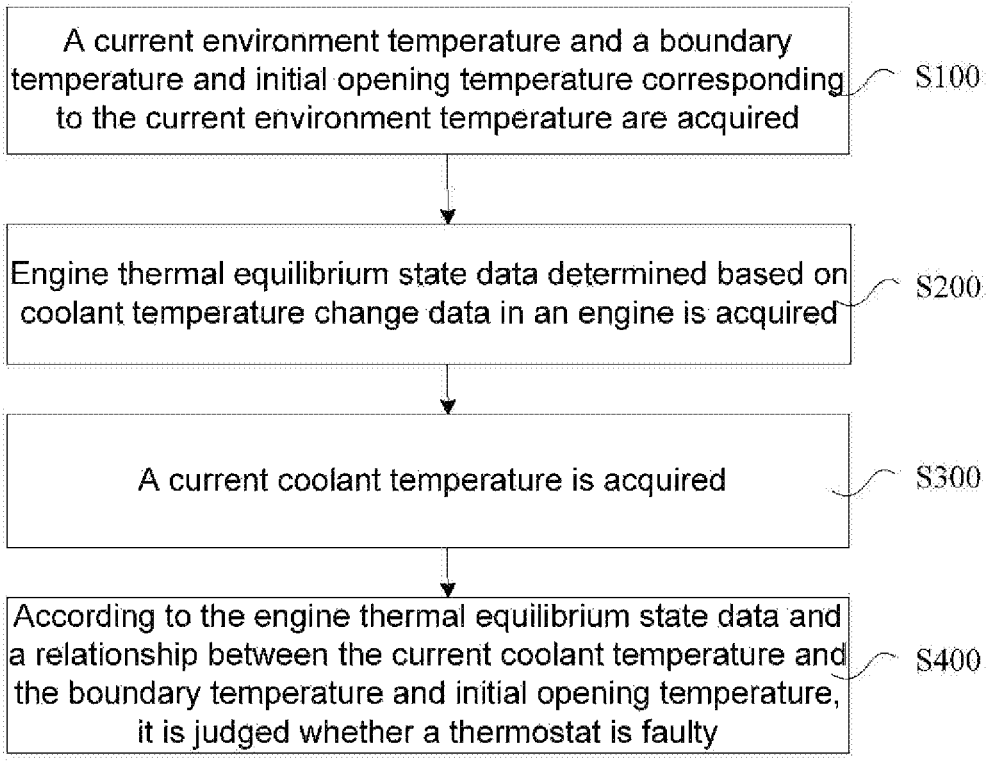
FIG. 1 is a flowchart of a thermostat fault diagnosis method according to an embodiment of the present disclosure.

At present, there is no mature thermostat diagnosis algorithm that satisfies the CN6 OBD regulations. In order to meet the requirements of the CN6 OBD regulations, an on-board thermostat diagnosis method is provided. As shown in FIG. 1, a thermostat fault diagnosis method includes the steps as follows.

At S100, a current environment temperature and a boundary temperature and initial opening temperature corresponding to the current environment temperature are acquired.

The environment temperature refers to the temperature of an external environment, and may be acquired by a temperature sensor. In the present embodiment, the obtained environment temperature may be used to determine a boundary temperature and an initial opening temperature corresponding to a current environment.

The boundary temperature refers to a coolant temperature when an engine reaches a thermal equilibrium state if the engine idle speed heater is turned to the maximum at each environment temperature. The initial opening temperature refers to the temperature of a corresponding engine coolant when a wax pack starts to melt in the thermostat. Based on the operating performance of the engine, the initial opening temperature will be greater than the boundary temperature.

Therefore, based on the acquired boundary temperature and initial opening temperature, three temperature ranges can be divided. In the present embodiment, a relationship between the current coolant temperature and the boundary temperature and the initial opening temperature, or a temperature range in which the current coolant temperature is located serves as an effective basis for selecting a fault determination method according to the current coolant temperature. Optionally, an interval in which the temperature value is lower than the boundary temperature may be set as a first temperature range, an interval in which the temperature value is greater than or equal to the boundary temperature and less than the initial opening temperature is set as a second temperature range, and an interval in which the temperature value is greater than or equal to the initial opening temperature is set as a third temperature range. In the following examples, these three sections are taken as an example for explanation.

At S200, engine thermal equilibrium state data determined based on coolant temperature change data in an engine is acquired.

In a specific example, coolant temperature change data in an engine may be acquired, and engine thermal equilibrium state data is determined according to the coolant temperature change data in the engine. The thermal equilibrium state refers to that the temperature is in a relatively stable interval, and the thermal equilibrium state during the operation of the engine is maintained by generally dissipating a part of heat by means of heat dissipation, so that the temperature of a coolant in the engine is in a relatively stable interval. Because the difference between a faulty thermostat and a normal thermostat in the engine is that before warm-up, cooling water of the faulty thermostat will make a large loop through a radiator, thus taking a lot of heat, causing the water temperature to rise slowly or causing the changes of a load and a vehicle speed to frequently fluctuate when the temperature is in the second temperature range; the normal thermostat does not pass through the radiator before reaching the warm-up temperature, and the changes of the loads and the vehicle speed rarely cause the water temperature to drop frequently. These changes can be judged according to the engine thermal equilibrium state data. The engine thermal equilibrium state data specifically refers to: the time at which the temperature of the coolant in the engine will not change, the duration of the state where the temperature does not change, a change condition of the equilibrium state in case of external disturbance, etc. Therefore, the thermal equilibrium state of the engine is emphasized.

At S300, a current coolant temperature is acquired.

The relationship between the current coolant temperature and the boundary temperature and initial opening temperature at the current environment temperature may be determined based on the current coolant temperature. For example, a temperature range in which the current coolant temperature is located is determined. It is confirmed how to determine a fault according to the thermal equilibrium state information according to the relationship between the current coolant temperature and the boundary temperature and initial opening temperature at the current environment temperature.

At S400, according to the engine thermal equilibrium state data and a relationship between the current coolant temperature and the boundary temperature and initial opening temperature, it is judged whether a thermostat is faulty.

The fault is determined by acquiring normal thermal equilibrium state information according to the current coolant temperature or thermal equilibrium change information that should be present under the stimulus, and combining the current thermal equilibrium state data, obtained in step S200.

In an embodiment, some fault thresholds may be set in advance, and then it is judged whether the change exceeds the fault thresholds, thereby performing fault determination. Optionally, the above-mentioned fault threshold may specifically include a standard engine minimum warm-up time, a standard thermal equilibrium duration time, and a coolant temperature drop parameter in the engine. These three sets of data can be obtained by pre-calibration, which are parameters used to assess the thermal equilibrium state of the engine. The standard engine minimum warm-up time is an engine running time when an engine idle speed heater is turned on to the maximum and the thermal equilibrium is reached at each pre-calibrated environment temperature. The standard engine thermal equilibrium time is a standard time of thermal equilibrium duration after the pre-calibrated engine reaches the thermal equilibrium. According to the standard engine thermal equilibrium time, an active control method or a temperature drop learning method can be selected for fault determination. The coolant temperature drop parameter in the engine is a calibrated normal temperature drop of the coolant during the cooling fan switching process at each environment temperature and starting temperature. The temperature drop refers to a temperature difference of adjacent peaks and troughs in a thermostat curve. The thresholds of the temperature drop under normal conditions or abnormal conditions can be confirmed by measurement, namely the first threshold in the active control method, the first preset number of times, the second threshold, and the second preset number of times. The coolant cooling parameter in the engine also includes a third threshold and a third preset number of times required for the determination through the calibrated temperature drop learning method. A preset engine standard thermostat parameter is used for calibrating the above parameters according to a current environment temperature and starting temperature, including calibration of 14 starts, where the environment temperature is −7 degrees, and the starting temperature is −7, 15, 30 or 50 degrees; the environment temperature is 0 degrees, and the starting temperature is 0, 25 or 50 degrees; the environment temperature is 10 degrees, and the starting temperature is 10, 25 or 50 degrees; the environment temperature is 25 degrees, and the starting temperature is 25 or 50 degrees; the environment temperature is 35 degrees, and the starting temperature is 35 or 50 degrees. The above calibration basically includes an automobile engine cold start and hot start. By pre-calibrating these data, the process of fault determination can be simplified, and a better determination result can be obtained.

Before the above-mentioned thermostat fault diagnosis process, a diagnosis enabling process may be included, that is, according to an engine water temperature sensor, a vehicle speed and other related fault states, as well as the environment temperature, the starting temperature, and the engine operating state, the conditions to be met specifically include that the engine has been started, there is no fault that affects the temperature of the coolant, the environment temperature is higher than minus 7 degrees, and the starting temperature is lower than 60. When all the conditions are met, the thermostat fault determination state is entered. Otherwise, the diagnosis enabling determination completion is waited.

In the above-mentioned thermostat fault diagnosis process, a diagnosis interrupt process should also be included, that is, the thermostat fault diagnosis is interrupted when a fault that affects the water temperature, an engine stop, and the phenomenon of a diagnosis time exceeding a maximum limit occur during the diagnosis.

Compared with a thermostat water temperature model method, the above thermostat fault diagnosis method has the advantages that it can be judged whether a thermostat is faulty by acquiring current thermal equilibrium state information according to an engine coolant temperature curve and then comparing calibrated thermal equilibrium fault thresholds without building a water temperature model, so that a determination result is more accurate, a large amount of standardization work is not needed, and the manpower and resource costs are reduced. Moreover, the normal thermostat does not pass through the radiator before reaching the warm-up temperature. The changes of the load and the vehicle speed rarely cause the water temperature to drop frequently. This is a characteristic shared by all vehicles. Therefore, for the matching of different cooling systems of different models, this method is applicable, and the versatility of the calibration data of this method is also strong. Even with respect to a thermostat valve displacement diagnosis method that requires the use of a displacement sensor, the diagnosis can be accurately performed without adding any hardware device, which can save a lot of cost.

In an embodiment, before a boundary temperature and an initial opening temperature within the range of a current environment temperature are acquired and a temperature range is divided according to the boundary temperature and the initial opening temperature, the method further includes the steps as follows.

The above engine thermal equilibrium fault threshold is calibrated at different environment temperatures and different starting temperatures, including calibration of 14 starts, where the environment temperature is −7 degrees, and the starting temperature is −7, 15, 30 or 50 degrees; the environment temperature is 0 degrees, and the starting temperature is 0, 25 or 50 degrees; the environment temperature is 10 degrees, and the starting temperature is 10, 25 or 50 degrees; the environment temperature is 25 degrees, and the starting temperature is 25 or 50 degrees; the environment temperature is 35 degrees, and the starting temperature is 35 or 50 degrees. The above calibration basically includes an automobile engine cold start and hot start.

Figure 2:
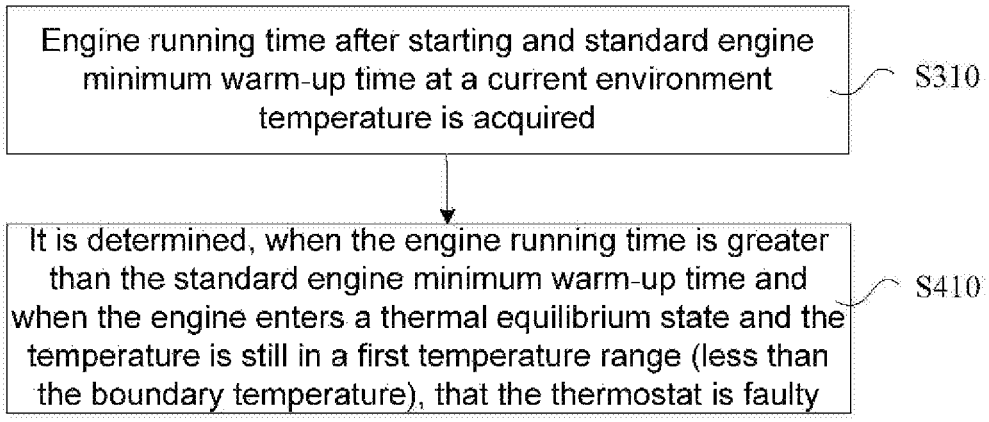
FIG. 2 is a flowchart of a boundary temperature method for a thermostat fault diagnosis method according to an embodiment of the present disclosure.
Figure 3:
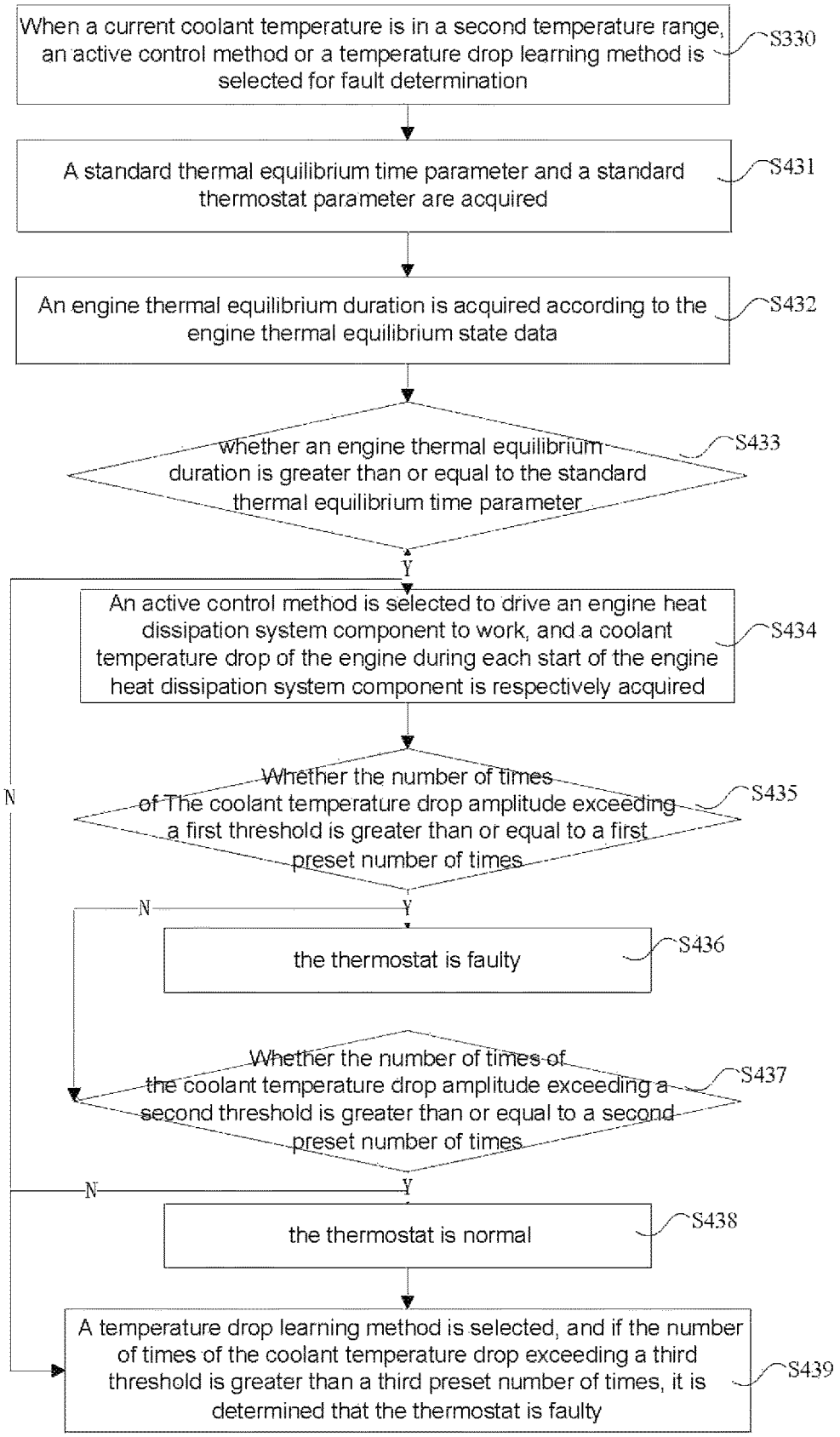
FIG. 3 is a flowchart of an active control method and a temperature drop learning method for a thermostat fault diagnosis method according to an embodiment of the present disclosure.
Figure 4:
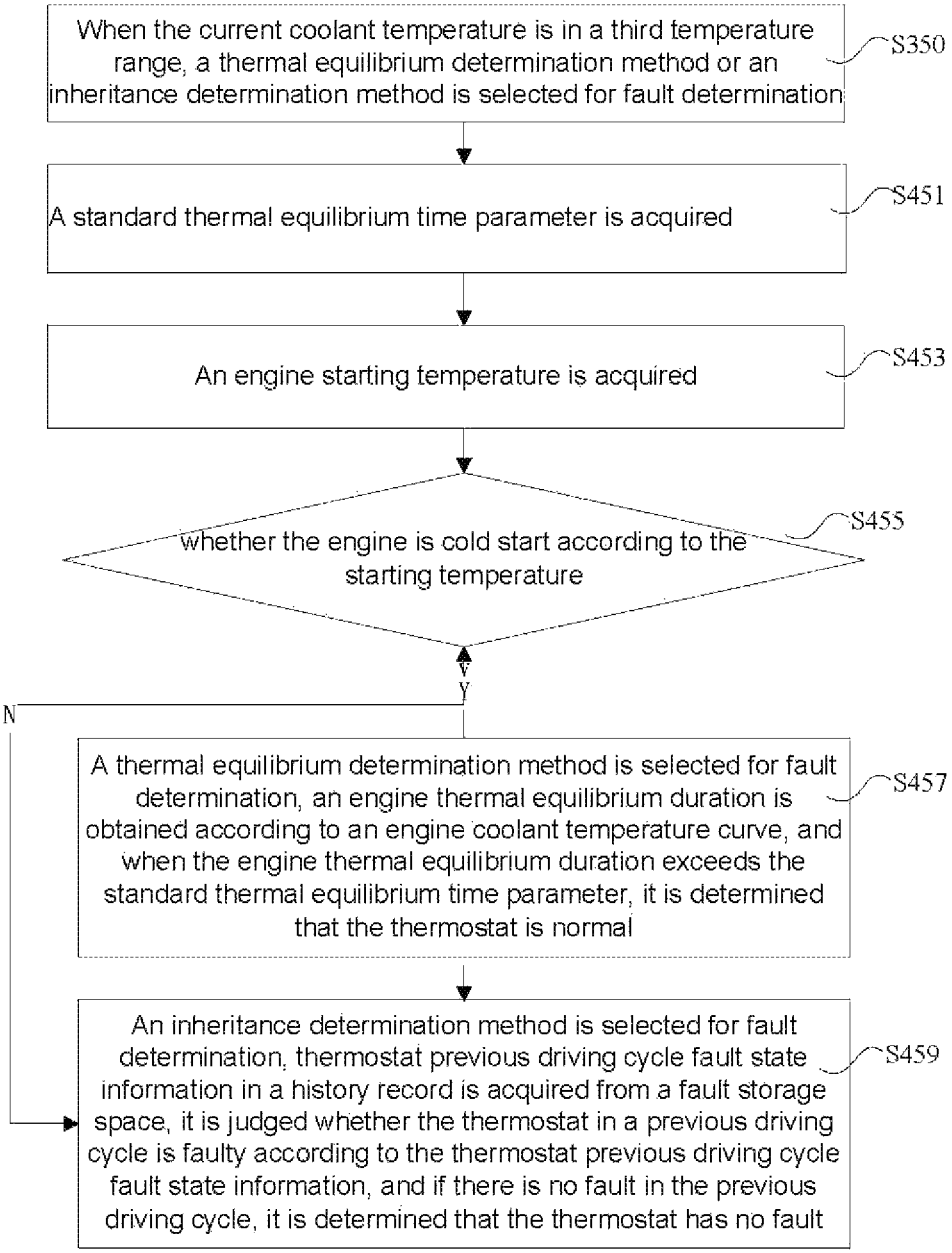
FIG. 4 is a flowchart of a thermal equilibrium determination method or an inheritance determination method according to an embodiment of the present disclosure.

As shown in FIG. 2, FIG. 3 and FIG. 4, in the pre-step, temperature ranges are divided, and a temperature range in which the current environment temperature is located is determined, and then it is confirmed whether the thermostat is faulty according to the engine thermal equilibrium state data. The method for determining whether the thermostat is faulty specifically includes a boundary temperature method, a temperature drop learning method, an active control method, a thermal equilibrium determination method or an inheritance determination method.

As shown in step S310, when the current coolant temperature is in a first temperature range, that is, when the current coolant temperature is less than the boundary temperature, a boundary temperature method is selected for fault determination. Specifically, it is judged whether the thermostat is faulty by the boundary temperature method according to the engine thermal equilibrium state data.

As shown in step S330, when the current coolant temperature is in a second temperature range, that is, when the current coolant temperature is greater than or equal to the boundary temperature and is less than the initial opening temperature, a temperature drop learning method or an active control method is selected for fault determination. Specifically, it is judged whether the thermostat is faulty by the temperature drop learning method or the active control method according to the engine thermal equilibrium state data.

As shown in step S350, when the current coolant temperature is in a third temperature range, that is, when the current coolant temperature is greater than or equal to the initial opening temperature, a thermal equilibrium determination method or an inheritance determination method is selected for fault determination. Specifically, it is judged whether the thermostat is faulty by the thermal equilibrium determination method or the inheritance determination method according to the engine thermal equilibrium state data.

As shown in FIG. 2, in an embodiment, the manner of performing, when the current coolant temperature is in the first temperature range, fault determination by using the boundary temperature method or judging whether the thermostat is faulty by the boundary temperature method according to the engine thermal equilibrium state data specifically includes the operations as follows.

At S310, engine running time after starting and standard engine minimum warm-up time at the current environment temperature is acquired.

At S410, it is determined, when the engine running time is greater than the standard engine minimum warm-up time and when the engine enters a thermal equilibrium state and the temperature is still in the first temperature range (less than the boundary temperature), that the thermostat is faulty.

After the engine coolant temperature enters the first temperature range, the boundary temperature method is used to perform judgment. First, a coolant temperature curve is acquired to obtain the engine thermal equilibrium state information, and the time when the engine enters a thermal equilibrium is confirmed. After the engine running time exceeds the standard engine minimum warm-up time, it is confirmed whether the engine enters the thermal equilibrium. If the thermal equilibrium is entered, it is confirmed whether the current coolant temperature is still in the first temperature range, it is determined that the thermostat is faulty if the current coolant temperature is still in the first temperature range, and the thermostat fault diagnosis process is ended. It is easy to, determine the fault state when the water temperature of the thermostat is low by the change of the thermal equilibrium state through the boundary temperature method.

As shown in FIG. 3, in an embodiment, when the current coolant temperature is in the second temperature range, that is, when the current coolant temperature is greater than or equal to the boundary temperature and is less than the initial opening temperature, the manner of selecting the active fan control method or the temperature drop learning method for fault determination or judging whether the thermostat is faulty by the temperature drop learning method or the active control method according to the engine thermal equilibrium state data includes the operations as follows.

At S431, a standard thermal equilibrium time parameter and a standard thermostat parameter are acquired.

At S432, the engine thermal equilibrium duration is acquired according to the engine thermal equilibrium state data.

At S433, it is judged whether an engine thermal equilibrium duration is greater than or equal to the standard thermal equilibrium time parameter; if so, the process proceeds to step S434, and the active control method is selected for fault determination; and otherwise, the process proceeds to step S439, and the temperature drop learning method is selected for fault determination.

At S434, an engine heat dissipation system component is driven to work by active control, heat dissipation coefficients of the heat dissipation system are changed, and a coolant temperature drop of the engine during each start of the engine heat dissipation system component is respectively acquired.

At S435, it is judged whether the number of times of the coolant temperature drop amplitude exceeding a first threshold is greater than or equal to a first preset number of times, when it is greater than or equal to the first preset number of times, the process proceeds to step S436 to determine that the thermostat is faulty, and the diagnosis process is ended. Otherwise, the process proceeds to step S438, it is judged whether the number of times of the coolant temperature drop amplitude lower than a second threshold is greater than or equal to a second preset number of times, when it is greater than or equal to the second preset number of times, the process proceeds to step S438 to determine that the thermostat is normal, and the diagnosis process is ended. If it is less than the second preset number of times, the process proceeds to step S439 to judge whether the thermostat is faulty by the temperature drop learning method. In particular, the change amount of the engine heat load input amount and the change amount of the vehicle speed during the fan opening and closing period are also acquired. If the two change amounts exceed a preset threshold, the process proceeds to step S438, and it is judged whether the thermostat is faulty by the temperature drop learning method.

At S439, when the engine thermal equilibrium duration is less than the standard thermal equilibrium time parameter or fault determination cannot be performed by using a fan control method, the temperature drop learning method is selected, if the number of times of the coolant temperature drop exceeding a third threshold is greater than a third preset number of times, it is determined that the thermostat is faulty, and the diagnosis process is ended. The first threshold, the first preset number of times, the second threshold, the second preset number of times, the third threshold and the third preset number of times are the coolant temperature drop parameters in the engine thermal equilibrium fault threshold calibrated during the calibration process.

When the thermal equilibrium state is maintained for a long period of time, external control is applied by the active control method, and it is possible to easily determine whether the thermostat is faulty according to whether the change of the thermal equilibrium state of the coolant in the thermostat under the external stimulus meets the expectation. When the thermal equilibrium state cannot be maintained for a long period of time, general data of the heat change in the engine is obtained by the temperature drop of the coolant, and fault determination is performed according to whether the heat change meets the expectation.

As shown in FIG. 4, in an embodiment, the manner of performing, when the current coolant temperature is in the third temperature range, fault determination by the thermal equilibrium determination method or the inheritance determination method specifically includes the operations as follows.

At S451, a standard thermal equilibrium time parameter is acquired. This is one of the engine thermal equilibrium fault thresholds calibrated during the calibration process.

At S453, an engine starting temperature is acquired, which is the temperature of the coolant in the engine when the engine is started.

At S455, it is judged whether the engine is cold start or hot start according to the starting temperature. The cold start is the start after the engine is stopped for a period of time (more than 8 hours). At this time, an intake system and a combustion chamber have no oil film accumulation, and a combustion chamber temperature is equal to the engine coolant temperature and an engine oil temperature. The hot start refers to the start soon after the engine is stopped. At this time, the engine coolant temperature is different from the engine oil temperature and the combustion chamber temperature.

If the engine is cold start, the process proceeds to step S457, and the thermal equilibrium determination method is selected. The engine thermal equilibrium duration is obtained according to an engine coolant temperature curve, when the engine thermal equilibrium duration exceeds the standard thermal equilibrium time parameter, it is determined that the thermostat is normal, and the judgment process is ended.

If the engine is hot start, the process proceeds to step S459, and the inheritance determination method is selected. Thermostat previous driving cycle fault state information in a history record is acquired from a fault storage space, it is judged whether there is a fault according to a previous driving cycle fault state, it is judged whether the thermostat in a previous driving cycle is faulty according to the thermostat previous driving cycle fault state information, and if there is no fault in the previous driving cycle, it is determined that the thermostat has no fault, wherein the fault storage space is used for storing thermostat fault information. The diagnosis result of the fault diagnosis method is stored into the fault storage space after each test is completed.

The state of the thermostat can be determined by the thermal equilibrium determination method. Since the function of the thermostat is to maintain the thermal equilibrium, if the engine can still be in thermal equilibrium for a long time after the thermostat is working normally, it is indicated that the thermostat has no fault. It is easy to clearly confirm whether there is a fault when the engine is hot start by the inheritance determination method.

In an embodiment, it is judged whether the thermostat is faulty by the determined judgment method according to the coolant temperature change curve and the preset engine standard thermostat parameter, and after the fault determination is completed, the method further includes the steps as follows.

Fault state information is generated according to a fault determination result, and the fault state information is written into a history record fault storage space. The fault storage space is in a processor of an on-board computer and used for storing fault information.

Figure 5:
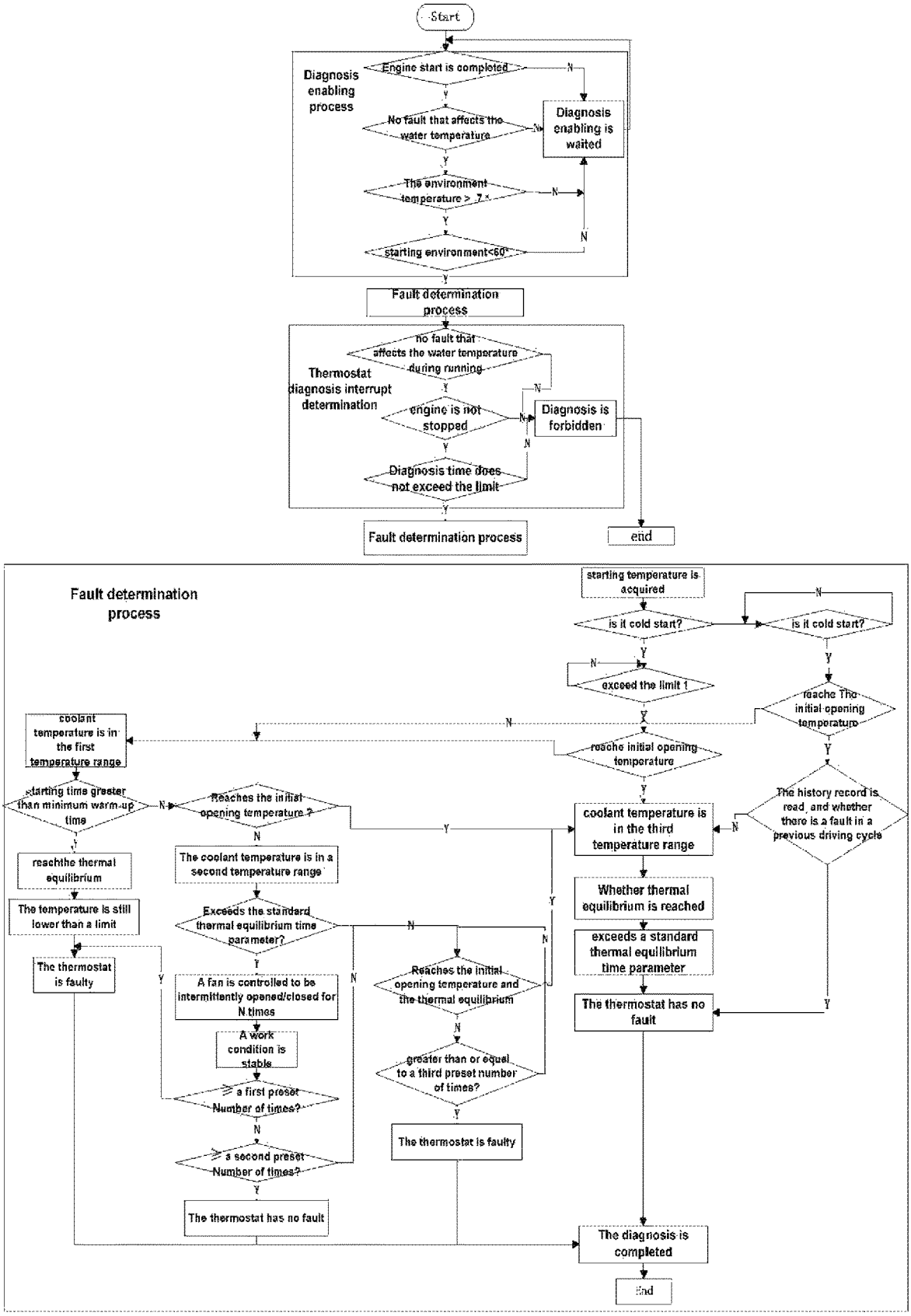
FIG. 5 is a flowchart of a thermostat fault diagnosis method according to an embodiment of the present disclosure.

As shown in FIG. 5, in a most specific embodiment, the fault diagnosis process includes a diagnosis enabling process, a thermostat diagnosis interrupt process, and a fault determination process.

The diagnosis enabling process refers to that according to an engine water temperature sensor, a vehicle speed and other related fault states, as well as the environment temperature, the starting temperature, and the engine operating state, the conditions to be met specifically include that the engine has been started, there is no fault that affects the temperature of the coolant, the environment temperature is higher than minus 7 degrees, and the starting temperature is lower than 60. When all the conditions are met, the thermostat fault, determination state is entered. Otherwise, the diagnosis enabling determination completion is waited.

The diagnosis interrupt process refers to that the thermostat fault diagnosis is interrupted when a fault that affects the water temperature, an engine stop, and the phenomenon of a diagnosis time exceeding a maximum limit occur during the diagnosis.

After the fault diagnosis process is entered, the coolant temperature is in the first temperature range, it is judged whether the engine starting time is greater than the minimum warm-up time. After the engine running time exceeds the standard engine minimum warm-up time, it is confirmed whether the engine enters the thermal equilibrium. If the thermal equilibrium is entered, it is confirmed whether the current coolant temperature is still in the first temperature range, it is determined that the thermostat is faulty if the current coolant temperature is still in the first temperature range, and the thermostat fault diagnosis process is ended.

If the engine starting time is less than the minimum warm-up time and the coolant temperature does not reach the initial opening temperature of melting of a wax pack in the thermostat, that is, it is in the second temperature range, it is judged whether the thermal equilibrium duration exceeds the standard thermal equilibrium time parameter, if so, the active control method is selected, and otherwise, the temperature drop learning method is selected. The active control method includes: controlling the intermittent opening/closing of a cooling fan for N times, and when the engine working condition is stable, judging whether the number of times of the coolant temperature drop amplitude exceeding the first threshold is greater than or equal to the first preset number of times. If so, it is determined that the thermostat is faulty, and the diagnosis process is ended. If not, it is judged whether the number of times of the coolant temperature drop amplitude exceeding the second threshold is greater than or equal to the second preset number of times, if so, determining that the thermostat has no fault, and the judgment process is ended. If not, the temperature drop learning method is selected for judgment.

Before the temperature drop learning judgment, it is judged whether the coolant temperature reaches the initial opening temperature. If the initial opening temperature is not reached, the temperature drop learning method is continued for judgment, otherwise, the thermal equilibrium determination method is used for judgment, if the number of times of the coolant temperature drop amplitude exceeding the third threshold is greater than or equal to the third preset number of times, it is determined that the thermostat is faulty, and the fault determination is ended. If it is less than or equal to the third preset number of times, the determination is repeated until the coolant temperature deviates from the second temperature range.

When the above three methods cannot be used for determination, the thermal equilibrium determination method or the inheritance determination method is used for the determination. It is judged whether the engine is cold start or hot start according to the starting temperature of the engine. When the engine is the cold start, if the warm-up time exceeds a limit 1 and the temperature reaches the initial opening temperature, the thermal equilibrium method can be used for judgment. If the initial opening temperature is not reached, the process jumps to the initial steps of the boundary temperature method for judgment. When the engine is the hot start, if the warm-up time exceeds a limit 2 and the temperature reaches the initial opening temperature, the inheritance determination method can be used for judgment. If the initial opening temperature is not reached, the initial steps of the boundary temperature method are adopted for determination. The use of the thermal equilibrium method specifically includes that: under the premise that the engine is cold start and the coolant temperature is in the third temperature range, the thermal equilibrium duration exceeds the standard thermal equilibrium time parameter to determine that the thermostat has no fault, and the fault diagnosis process is ended. The use of the inheritance determination method specifically includes that: under the premise that the engine is hot start and the coolant temperature is in the third temperature range, a history record is read, data of a previous history record is acquired, it is judged whether the thermostat is faulty in a previous driving cycle, when the thermostat has no fault, it is determined that the thermostat has no fault, and the fault diagnosis process is ended. Fault state information is generated according to a fault determination result, and the fault state information is written into a history record fault storage space. The fault storage space is in a processor of an on-board computer and used for storing fault information.

Figure 6:
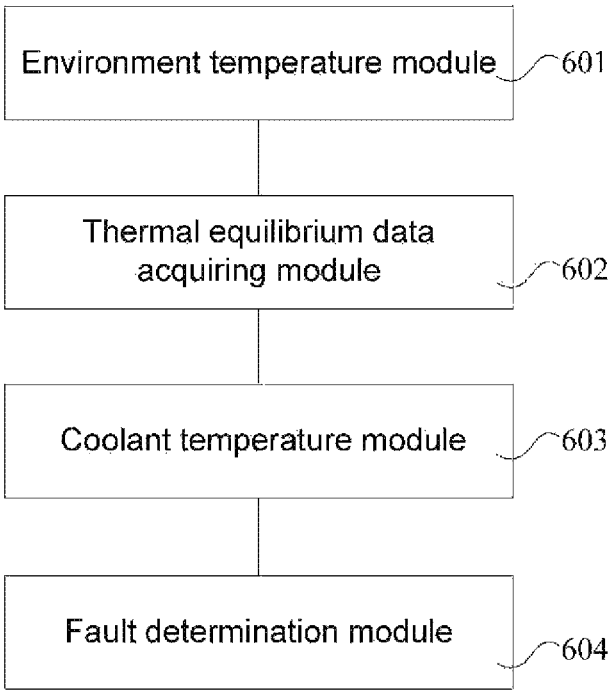
FIG. 6 is a structural diagram of a thermostat fault diagnosis device according to an embodiment of the present disclosure.

As shown in FIG. 6, a thermostat fault diagnosis device includes: an environment temperature module 601, a thermal equilibrium data acquiring module 602, a coolant temperature module 603 and a fault determination module 604.

The environment temperature module 601 is configured to acquire a current environment temperature and a boundary temperature and initial opening temperature corresponding to the current environment temperature.

The thermal equilibrium data acquiring module 602 is configured to acquire engine thermal equilibrium state data determined based on coolant temperature change data in an engine.

The coolant temperature module 603 is configured to acquire a current coolant temperature.

The fault determination module 604 is configured to judge, according to the engine thermal equilibrium state data and a relationship between the current coolant temperature and the boundary temperature and initial opening temperature, whether a thermostat is faulty.

By means of the above thermostat fault diagnosis device, it can be judged whether a thermostat is faulty by acquiring current thermal equilibrium state information according to an engine coolant temperature curve and then comparing calibrated thermal equilibrium fault thresholds without building a water temperature model, so that a determination result is more accurate, a large amount of standardization work is not needed, and the manpower and resource costs are reduced. Moreover, the normal thermostat does not pass through the radiator before reaching the warm-up temperature. The changes of the load and the vehicle speed rarely cause the water temperature to drop frequently. This is a characteristic shared by all vehicles. Therefore, for the matching of different cooling systems of different models, this method is applicable, and the versatility of the calibration data is also strong. Even with respect to a thermostat valve displacement diagnosis method that requires the use of a displacement sensor, the diagnosis can be accurately performed without adding any hardware device, which can save a lot of cost.

In an embodiment, the fault determination module 604 specifically includes: a first fault determination unit, a second fault determination unit and a third fault determination unit.

The first fault determination unit is configured to judge, when the current coolant temperature is less than the boundary temperature, whether the thermostat is faulty by a boundary temperature method according to the engine thermal equilibrium state data.

The second fault determination unit is configured to judge, when the current coolant temperature is greater than or equal to the boundary temperature and is less than the initial opening temperature, whether the thermostat is faulty by a temperature drop learning method or an active control method according to the engine thermal equilibrium state data.

The third fault determination unit is configured to judge, when the current coolant temperature is greater than or equal to the initial opening temperature, whether the thermostat is faulty by a thermal equilibrium determination method or an inheritance determination method according to the engine thermal equilibrium state data.

In an embodiment, the first fault determination unit is specifically configured to: acquire engine running time after starting and standard engine minimum warm-up time at the current environment temperature; and determine, when the engine running time is greater than the standard engine minimum warm-up time and when the engine enters a thermal equilibrium state and the temperature is still less than the boundary temperature, that the thermostat is faulty.

In an embodiment, the second fault determination unit is specifically configured to: acquire an engine thermal equilibrium duration according to the engine thermal equilibrium state data; drive, when the engine thermal equilibrium duration is greater than or equal to a standard thermal equilibrium time parameter, an engine heat dissipation system component to work, respectively acquire a coolant temperature drop of the engine during each start of the engine heat dissipation system component, when the number of times of the coolant temperature drop amplitude exceeding, a first threshold is greater than or equal to a first preset number of times, determine that the thermostat is faulty, and when the number of times of the coolant temperature drop amplitude is lower than a second threshold is greater than or equal to a second preset number of times, determine that the thermostat is normal; and when the engine thermal equilibrium duration is less than the standard thermal equilibrium time parameter or fault determination cannot be performed by using a fan controller, if the number of times of the coolant temperature drop exceeding a third threshold is greater than a third preset number of times, determine that the thermostat is faulty.

In an embodiment, the third fault determination unit is specifically configured to: acquire a standard thermal equilibrium time parameter; determine a starting mode of the engine based on a starting temperature; obtain, if the starting mode is cold start, the engine thermal equilibrium duration according to an engine coolant temperature curve, and when the engine thermal equilibrium duration exceeds the standard thermal equilibrium time parameter, determine that the thermostat is normal; and acquire, if the starting mode is hot engine start, thermostat previous driving cycle fault state information, and judge whether the thermostat in a previous driving cycle is faulty according to the thermostat previous driving cycle fault state information.

In an embodiment, the thermostat fault, diagnosis device further includes: a fault storage unit.

The fault storage unit is configured to generate fault state information according to a fault determination result, and write the fault state information into a history record.

A computer device includes a memory, a processor and a computer program that is stored on the memory and runnable on the processor, wherein the program is executed by the processor to implement the steps of the method according to any of the above.

A computer-readable storage medium has a computer program stored thereon, wherein the program is executed by a processor to implement the steps of the method according to any of the above.

By means of the above thermostat judging method and device, the computer device and the computer-readable storage medium, it can be judged whether a thermostat is faulty by acquiring current thermal equilibrium state information according to an engine coolant temperature curve and then comparing calibrated thermal equilibrium fault thresholds without building a water temperature model, so that a determination result is more accurate, a large amount of standardization work is not needed, and the manpower and resource costs are reduced. Moreover, the normal thermostat does not pass through the radiator before reaching the warm-up temperature. The changes of the load and the vehicle speed rarely cause the water temperature to drop frequently. This is a characteristic shared by all vehicles. Therefore, for the matching of different cooling systems of different models, this method is applicable, and the versatility of the calibration data is also strong.

The technical features of the above-described embodiments may be arbitrarily combined. For the sake of brevity of description, all possible combinations of the technical features in the above embodiments are not described. However, as long as there is no contradiction between the combinations of these technical features, all should be considered as the scope of this description.

The above embodiments are merely illustrative of several implementation manners of the present disclosure with specific and detailed description, and are not to be construed as limiting the patent scope of the present disclosure. It is to be noted that a number of variations and modifications may be made by those of ordinary skill in the art without departing from the conception of the present disclosure, and all fall within the scope of protection of the present disclosure. Therefore, the scope of protection of the present disclosure should be determined by the appended claims.

What is claimed is:

1. An engine thermostat fault diagnosis method, comprising:

acquiring a current environment temperature and a boundary temperature and initial opening temperature corresponding to the current environment temperature;

acquiring engine thermal equilibrium state data determined based on coolant temperature change data in an engine;

acquiring a current coolant temperature; and judging, according to the engine thermal equilibrium state data and a relationship between the current coolant temperature and the boundary temperature and initial opening temperature, whether a thermostat is faultyl judging, when the current coolant temperature is less than the boundary temperature, whether the thermostat is faulty by a boundary temperature method according to the engine thermal equilibrium state data;

judging, when the current coolant temperature is greater than or equal to the boundary temperature and is less than the initial opening temperature, whether the thermostat is faulty by a temperature drop learning method or an active control method according to the engine thermal equilibrium state data; and judging, when the current coolant temperature is greater than or equal to the initial opening temperature, whether the thermostat is faulty by a thermal equilibrium determination method or an inheritance determination method according to the engine thermal equilibrium state data;

acquiring a standard thermal equilibrium time parameter;

determining a starting mode of the engine based on a starting temperature; and;

if the starting mode is cold start, obtaining the engine thermal equilibrium duration according to an engine coolant temperature curve, and when the engine thermal equilibrium duration exceeds the standard thermal equilibrium time parameter, determining that the thermostat is normal.

2. The thermostat fault diagnosis method as claimed in claim 1, wherein the manner of judging, when the current coolant temperature is greater than or equal to the initial opening temperature, whether the thermostat is faulty by a thermal equilibrium determination method or an inheritance determination method according to the engine thermal equilibrium state data further comprises:

if the starting mode is hot engine start, acquiring thermostat previous driving cycle fault state information, and judging whether the thermostat in a previous driving cycle is faulty according to the thermostat previous driving cycle fault state information.

3. The thermostat fault diagnosis method as claimed in claim 2, wherein after judging whether the thermostat is faulty, the method further comprises:

generating fault state information according to a fault determination result, and writing the fault state information into a history record.

4. A computer device, comprising a memory, a processor and a computer program that is stored on the memory and runnable on the processor, wherein the program is executed by the processor to implement the steps of the method as claimed in claim 1.

5. A computer-readable storage medium, having a computer program stored thereon, wherein the program is executed by a processor to implement the steps of the method as claimed in claim 1.

6. The thermostat fault diagnosis method as claimed in claim 1, wherein after judging whether the thermostat is faulty, the method further comprises:

generating fault state information according to a fault determination result, and writing the fault state information into a history record.

7. A thermostat fault diagnosis device, comprising:

an environment temperature module, configured to acquire a current environment temperature and a boundary temperature and initial opening temperature corresponding to the current environment temperature;

a thermal equilibrium data acquiring module, configured to acquire engine thermal equilibrium state data determined based on coolant temperature change data in an engine;

a coolant temperature module, configured to acquire a current coolant temperature; and a fault determination module, configured to judge, according to the engine thermal equilibrium state data and a relationship between the current coolant temperature and the boundary temperature and initial opening temperature, whether a thermostat is faulty;

wherein the fault determination module is further configured to judge, when the current coolant temperature is less than the boundary temperature, whether the thermostat is faulty by a boundary temperature method according to the engine thermal equilibrium state data; judge, when the current coolant temperature is greater than or equal to the boundary temperature and is less than the initial opening temperature, whether the thermostat is faulty by a temperature drop learning method or an active control method according to the engine thermal equilibrium state data; and judge, when the current coolant temperature is greater than or equal to the initial opening temperature, whether the thermostat is faulty by a thermal equilibrium determination method or an inheritance determination method according to the engine thermal equilibrium state data, wherein the thermal equilibrium data acquiring module is further configured to acquire a standard thermal equilibrium time parameter; the fault determination module is further configured to determine a starting mode of the engine based on a starting temperature, if the starting mode is cold start, the fault determination module obtain the engine thermal equilibrium duration according to an engine coolant temperature curve, and the fault determination module determines that the thermostat is normal when the engine thermal equilibrium duration exceeds the standard thermal equilibrium time parameter.

* * * * *